United States Patent [19]

Crawford

[11] Patent Number: 4,520,567

[45] Date of Patent: Jun. 4, 1985

[54] POWER PIERCE CAN OPENER

[75] Inventor: John G. Crawford, Monroe, Conn.

[73] Assignee: Black & Decker, Inc., Newark, Del.

[21] Appl. No.: 485,593

[22] Filed: Apr. 18, 1983

[51] Int. Cl.[3] ..... B67B 7/38

[52] U.S. Cl. ..... 30/424; 30/307; 30/347; 30/426; 30/441

[58] Field of Search ..... 30/420–427, 30/433, 434, 440, 441, 205–207, 240, 263–265, 306, 307, 347; 83/676

[56] References Cited

U.S. PATENT DOCUMENTS

| | | | |
|---|---|---|---|
| D. 57,798 | 5/1921 | Till | 30/440 X |
| 2,614,320 | 10/1952 | Rosenberry . | |
| 2,824,366 | 2/1958 | Sarff | 30/424 |
| 3,439,418 | 4/1969 | Myers | 30/420 |
| 3,781,989 | 1/1974 | Swetzlitz et al. | 30/425 |

*Primary Examiner*—Douglas D. Watts
*Attorney, Agent, or Firm*—Paul J. Lerner

[57] ABSTRACT

An electric powered can opener has a housing, a feed gear that is motor connected and rotatably mounted to drive and rotate a can by holding it by its rim. An operating lever is pivoted above the gear on the housing and carries a cutter mechanism to remove the can lid. To this conventional arrangement an improvement is added in the cutter mechanism of a non-round cutter wheel connected to and movable by the lever and having a lobed or flat portion within the periphery and oriented so that the cutter wheel is substantially stationary as it is pulled into the can lid such that the meeting edge of the periphery at the flat and round periphery provides a power pierce whereupon the cutter wheel then rotates for a clean severing of the can lid. The cutter is preferably a dish-shaped cutter with a hollow ground flat or lobe portion. The lever is preferably spring biased for rotation toward the can at all times and has a slidable switch actuator that is linkage-connected to the lever for manual operation.

7 Claims, 6 Drawing Figures

POWER PIERCE CAN OPENER

BACKGROUND OF THE INVENTION

1. Field of the Invention

The invention is directed to an electric can opener with a simple arrangement of a pivoting cutter wheel mechanism having at least one or more irregular peripheral portions in the form of lobes or flats with the mechanism being so oriented as to pull the cutter into the can to provide a stationary power pierce and then roll it to provide a smooth severing of the lid.

2. Description of the Prior Art

Electric can openers have become a common household appliance designed to a high degree of usefulness, cleanability, cut lid holding, and various forms of power pierce. The plow cutter, a pointed cutter piercing the can—like a can of motor oil is pierced by its attaching spout—has been replaced by the rolling cutter wheel which generally reduces the metal slivers inevitably produced during a cutting operation and which may drop into the food. One of the disadvantages of the rotating cutting wheel is difficulty of piercing the can top because of the large force required over that of the old pointed plow cutter which easily pierced the can. Nevertheless, numerous arrangements have been provided to provide a power pierce so that the energy of the driving motor is used to pierce the lid and avoid the large manual force by the user on the operating lever. Numerous power pierce arrangements have been provided and a typical one is shown in U.S. Pat. No. 3,121,285 of common assignment, which, in effect, gives the puncturing cutter a running start by rotating the can before puncturing the lid to power assist the actual puncturing. Another form of power pierce is shown in U.S. Pat. No. 3,946,485 which uses many parts in a different pivoting and lever arrangement whereby the piercing force is multiplied momentarily to pierce the can lid by the cutter wheel. Thus, power pierce per se is not new. Additionally, the use of non-round cutter wheels in order to take advantage of the piercing force of pointed or lobed surfaces is not new. Such a plow type square cutter for a can opener is shown in U.S. Pat. No. 3,439,418 which provides a large piercing force on one of the points but also has the defect of slivering common in plow cutters. Generally, non-round cutter wheels may take several forms such as the lobed cutter of U.S. Pat. No. 1,876,075 directed to a cutter per se.

It is the primary object of the invention to provide an improved power pierce for an electric can opener with a simple addition to put in conventional structure without the complexity of additional levers, pivoting arrangements, or inducing delays in the actual piercing of the lid.

Another object is to provide the power pierce structure by the use of a non-round cutter wheel oriented on its pivoted lever such that the cutter wheel is substantially stationary when it engages the can and is then pulled into a power piercing operation simply and easily to subsequently roll and sever the lid with no ragged edge.

It is a further object of the invention to linkage connect the automatic or cutter mechanism with a specially shaped cutter wheel which, with a simple single sliding switch actuator provides easy power pierce and start and stop operation with no additional structure.

The present invention is an alternate arrangement in the same general can opener structure shown in application Ser. No. 06/359,562 filed Mar. 18, 1982 of common assignment.

SUMMARY OF THE INVENTION

In accordance with the invention, a conventional electric powered can opener has a housing with a feed gear rotatably mounted thereon to drivingly hold and rotate a can by its rim. An operating lever is pivoted above the feed gear on the housing and carries a cutter mechanism that is swung into position to cut and remove the can lid. To this standard structure, an improvement in the cutter mechanism is provided by using a cutter wheel rotatably pivoted at one end of the lever. The wheel has at least a single lobed portion on and within the wheel periphery thus providing a non-round wheel. Further, the wheel is oriented on the lever so the extension of the lever longitudinal axis through the wheel pivot falls inside the meeting edge of the lobe and wheel periphery when the lobe lies flat on the lid of a can. This locates the point of can contact outside of the meeting edge such that the cutter free wheels until the meeting edge contacts the can outside the extension and the lobe is then forced stationary into and power pierces the can lid whereupon the cutter then rotates smoothly severing the lid. The lobe portion may preferably be a flat extending across the periphery of the cutter wheel such that the meeting edge is the intersection of the flat and the wheel periphery at the can contact point. To provide an inexpensive cutter wheel, it may be dish-shaped in cross-section and the peripheral flat is formed as a hollow grind on the periphery on the inside of the dish so that it maintains a smooth cut edge quality on the can as it is severed. The entire operating lever may be linked and connected through the housing to a slidable switch actuator that easily initiates the start, running, power piercing, and rotating removal of the lid while turning the can. Thus, the main object of the present invention is to provide an improved cutter mechanism using a non-round cutter wheel to provide power pierce while using all the standard parts already present and, by orientation, causing the non-rounded or lobed portion to stationarily power pierce the lid and the cutter then rotates for smooth severing of the lid.

DESCRIPTION OF THE PREFERRED EMBODIMENT

Figure 1:
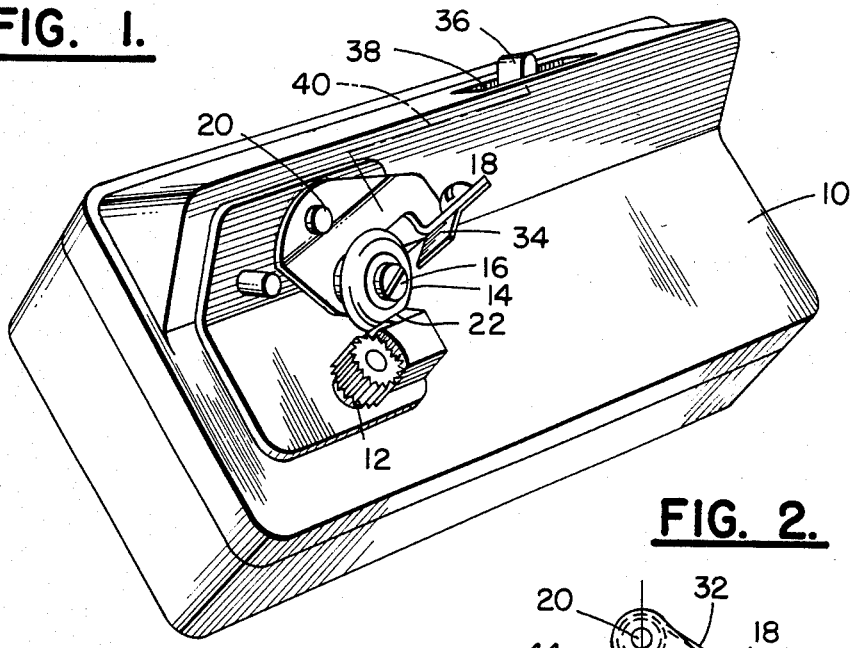
FIG. 1 is a perspective view of a can opener showing the formed and oriented single operating lever of the invention.

Referring to FIG. 1, there is shown a typical electric powered can opener having a housing 10 and enclosing an internal motor not shown and adapted to be plugged in the house current to operate in conventional fashion. The can opener may take any suitable forms such as hanging under a kitchen cabinet by mounting in a suitable bracket or may stand on legs as shown in U.S. Pat. No. 2,979,300 of common assignment or merely operate at the edge of a counter top of the general type shown in said U.S. Pat. No. 3,121,285.

As such, the can opener is provided with a serrated feed gear 12 through suitable gearing not shown for counterclockwise rotation in the FIG. 1 embodiment. The feed gear holds and rotates a can by its rim while a cutter is rotated into position to pierce and cut the can lid in conventional fashion. While any suitable plow or wheel cutter may be used, the round cutter wheel 14 has replaced the blade or power cutter as preferable because it is easily removed by a screw 16 for replacement or cleaning and generally does a better job of cutting by producing fewer slivers of metal than the old plow cutter. In order to bring the operating mechanism into cutting position, cutter wheel 14 is mounted on an operating lever 18 of suitable shape with the lever pivoted at 20 on the housing generally substantially above feed gear 12. In operation, the operating lever 18 through suitable mechanism is rotated to carry the cutter wheel 14 into the can top and start the can opening operation as is well known.

Usually the force required for cutter 14 to pierce the can lid is enhanced by various means for a larger mechanical advantage on the operating lever so the user benefits from a lower actuating force than merely pushing cutter wheel 14 with its rounded periphery directly into the can top. With an electric powered can opener, it is possible to use the electric motor as an assist and a power pierce may also be obtained by a "running start" as described in said U.S. Pat. No. 3,121,285 or equivalent as in said U.S. Pat. No. 3,946,485. Generally, power pierce requires additional structure and to avoid this, the present invention provides an improvement on those patents and an alternate to the co-pending application Ser. No. 06/359,562 supra.

Figure 2:
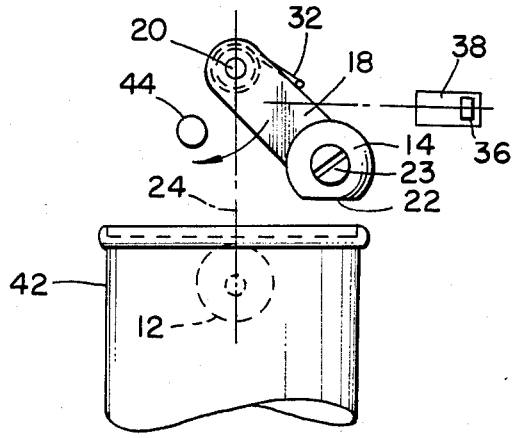
FIGS. 2–4 are diagrammatic showings of the operation of the cutter mechanism approaching in FIG. 2, biting and power pierce in FIG. 3, and cutting in FIG. 4.
Figure 3:
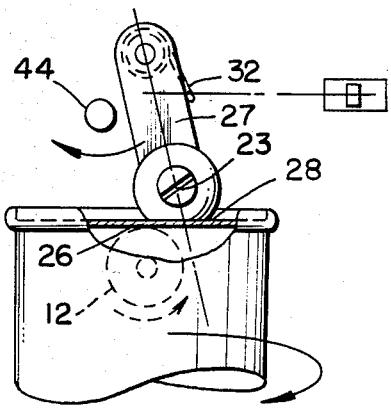
Figure 4:
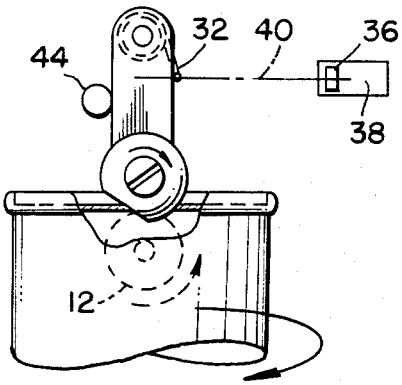

As shown in FIG. 1 and diagrammatically in FIGS. 2–4, the improvement of the present invention is in the cutter mechanism wherein a lobed portion preferably but not necessarily in the form of a flat 22 is provided on the cutter wheel. This flat is a ground-in portion on and within the wheel periphery as shown and the entire cutter wheel is removably and rotatably pivoted at 23 at one end of the operating lever 18 as seen in FIGS. 1–4. As shown, pivot 20 of lever 18 preferably is substantially vertically above pivoted cutter wheel 14 or on a line 24 as shown in FIG. 2. At the start, the flat 22 on cutter 14 may be in any position around the periphery due to free wheeling of the cutter, the horizontal position of FIG. 2 being shown for descriptive purposes only. As lever 18 rotates from the position of FIG. 2 to that of FIG. 3 or as the wheel flat contacts substantially near the top 26 of feed gear 12, it will be apparent that no matter what stationary position flat 22 is in FIG. 2, it is forced, by its edge contact, to rotate slightly from its stationary position down into the position shown in FIG. 3 with the flat on the can lid which has not yet been pierced. Thus, cutter wheel 14 automatically assumes the position on the can as shown in FIG. 3 with, at this position, no severing yet of the can lid. In order to obtain a power pierce under the actuation of the driving motor, it is important that the cutter wheel flat 22 be specifically oriented on lever 18 so that the extension of the lever longitudinal axis 27 through the wheel pivot 23 falls on the inside of the meeting edge of the flat or lobe and the wheel periphery. The meeting edge is defined as the intersection of the flat and the round periphery of the wheel at the can contact point. Thus, as shown in FIG. 3, the meeting edge of the lobe or flat and wheel periphery is at 28 and the wheel must be so oriented that the extension of line 27 falls inside 28. In other words, the point of can contact at 28 is outside the extension of line 27 as shown. With this particular orientation, the full power pierce can be applied along the flat 22 between the can lid and cutter wheel to pull the wheel into the lid and power pierce it as shown in FIG. 4. It should be noted that if the flat 22 is not horizontal as shown in FIG. 1, the cutter can free wheel or spin until the edge contacts the can so it is substantially stationary and the flat is in the position of FIG. 3 when the motor drives it into the can top for a power pierce much like the plow cutter and then on into the position of FIG. 4. With this orientation, the cutter wheel then rotates smoothly to cut as a round cutter with few chips and a smooth edge in the conventional fashion. If the extension of the lever longitudinal axis 27 falls outside of the meeting edge 28 i.e. if the flat subtends a much smaller arc of the cutting wheel, so the meeting edge 28 falls inside of the axis 27, the result is a moment in the opposite or clockwise direction which causes lever 18 to rise allowing the can to "jump" the flat 22. The orientation so the extension 27 falls inside the meeting edge 28 as in FIG. 3 results in a counterclockwise moment which as the friction increases, becomes large enough for the flat to pierce the can whereupon the cutter wheel rotates for a smooth cut.

In actual construction, the pivot axis 20 of lever 18 might be $\pm 10°$ either side of feed gear 12 with a vertical alignment being preferred. Additionally, in order to provide a sufficient piercing force, the distance from the lever pivot at 20 to the center of the cutter flat must be greater, when the cutter flat is perpendicular to the lever longitudinal axis extention, than the distance from the lever pivot to the can so that the flat is forced into the can top as in FIG. 3.

Figure 5:
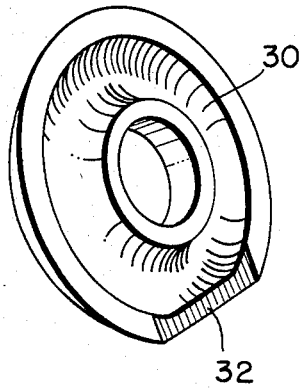
FIG. 5 is a perspective of a typical cutter wheel showing the hollow ground flat on the periphery and, FIG. 6 is an elevation view of the wheel of FIG. 5 also showing the dish shape and hollow ground flat.
Figure 6:
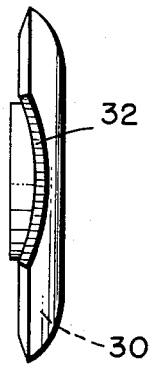

The round wheel cutter previously described and in common usage has the advantage of lower power requirements and lack of metal chip generation and is now used by most of the kitchen can openers. A universal feature of this type cutter is the substantially angled entry to the can so the angled or rounded back profile presses against the inside of the can as the lid is cut. This turns the can cut edge into the can side wall to leave the can virtually burr and sharp edge free. Because of the desirability of the lobe or flat on the perimeter as discussed herein, all the obvious means to obtain the flat result in loss of back profile integrity and thus in the quality of the cut can seam edge. As shown in FIGS. 5 and 6, this disadvantage is obviated by the use of a dish-shaped cutter wheel as shown in cross-section taken through the view of FIGS. 5 and 6 with the dish portion 30 as shown. In order to provide the flat to such a dish-shaped cutter, a hollow grind 33 is applied to a sector of the peripheral front face of the cutter and on the inside of the dish such that when the cutter is viewed at its angle of entry to the can, this form of cut provides the desired peripheral flat. While only a hollow grind is necessary on the dish-shaped cutter, actually the radius of the grind is a mathematical function of the diameter and profile of the cutter and its angle of can entry. Suffice to say, this form of grind, for the purposes of the invention, provides the peripheral flat necessary for the power pierce and as applied to the dish-shaped cutter the can cut edge quality is maintained.

For convenient operation by the user, it is desired to bias lever 18 for rotation toward the can by a suitable spring 32 as shown diagrammatically in FIGS. 2–4. Further, to provide driving contact at all times between the can rim and the feed gear 12, lever 18 has a suitable horizontal guide spring plate 34 which helps to align the can and bias against the feed gear 12 when in cutting position as shown in FIG. 4.

For convenient external operation, a slidable switch actuator 36 is provided at a convenient location in the housing to slide in slot 38 and, through suitable connected linkage 40 shown diagrammatically in FIGS. 1–4, the operating lever 18 can be manually actuated against the bias of spring 32 by sliding button 36 in the housing and the button can also be connected to start the motor.

In operation, button 36 is pulled to the right or FIG. 2 position, can 42 is inserted with its rim resting on feed gear 12 and, through suitable guides and rests known in the art, biased on the gear and positioned for cutting. Actuator button 36 is released whereupon bias of spring 32 drops lever 18. A continuation of movement of actuator button 36 will not farther move the lever, but may turn on the power rotating feed gear 12 in any suitable manner. Various known guides and locating members orient the can on the opener. Also, clockwise rotation of lever 18 under the bias of spring 32 permits the lever to move while cutter 14 free wheels. During the movement clockwise, flat 22 comes into contact partly and then completely with the can and takes the FIG. 3 position with its meeting edge 28 outside lever longitudinal axis 27. This causes the flat, under motor operation, to pull cutter 14 into and pierce the can lid for a power pierce. The cutter 14 then rolls like any wheel cutter and cleanly severs the can lid as it rolls as shown in FIG. 4. When severed, the operation is stopped by any several well known automatic stops such as 44, not forming part of the instant invention whereupon the can may be removed by slightly turning it, tilting it, or by moving button 36 back into FIG. 2 position against the bias of spring 32 and the can is then free for removal.

Generally, a screw may be used at pivot 23 to releasably attach the cutter to the can opener for removal in cleaning. Also, the usual magnet structure holds the severed lid and both are well known in the art and form no part of the present invention.

Thus, the described invention provides a simple means on the usual operating lever and requires no extra parts for a simple modification of a flat on a dish-shaped 30 cutter wheel all providing power pull of cutter 14 into piercing and cutting operation and without the addition of any complexity or extra parts. This is an alternate form of the same invention disclosed in said commonly-assigned application Ser. No. 06/359,562 filed Mar. 18, 1982.

While there has been described a preferred form of the invention, obvious equivalent variations are possible in light of the above teachings. For example, multiple lobes or flats may be used if desired as long as there is at least one as taught herein. It is therefore to be understood that, within the scope of the appended claims, the invention may be practiced otherwise than as specifically described and the claims are intended to cover such equivalent variations.

I claim:

1. An electric powered can opener having a housing, a feed gear rotatably mounted to drivingly hold and rotate a can by its rim, an operating lever pivoted above said gear on the housing and carrying a cutter mechanism to contact and remove the can lid, an improvement in said mechanism comprising:

a cutter wheel rotatably pivoted at one end of said lever, said wheel having a flat chordal portion on and within the wheel periphery said wheel being located on said lever so a line drawn through said wheel pivot and said lever pivot falls inside the meeting edge of said flat and said wheel periphery when said flat lies along the lid of a can, whereby the cutter free wheels until the meeting edge contacts the can, outside said line and the flat is forced stationary into and pierces the can lid whereupon the cutter rotates severing the lid.

2. Apparatus as described in claim 1, wherein the pivot axis of said lever is within $\pm 10°$ from a vertical through the feed gear center.

3. Apparatus as described in claim 1 wherein the distance from the lever pivot to the center of the cutter flat is greater when the cutter flat is perpendicular to the longitudinal axis extension, than the distance from the lever pivot to the can lid to provide a power pierce.

4. Apparatus as described in claim 3 wherein said lever is spring-biased for rotation toward the can.

5. Apparatus as described in claim 4 wherein said lever has horizontal guide means thereon for can alignment and biasing against the feed gear.

6. Apparatus as described in claim 5 having, slidable switch actuator means on said housing linkage-connected to said lever for manual operation thereof.

7. Apparatus as described in claim 6 wherein said cutter wheel is, dish-shaped in cross-section and the peripheral flat is, a hollow grind on the periphery at the inside of said dish to maintain cut edge quality on the can at the severed portion.

* * * * *